United States Patent [19]

Montgomery, Jr.

[11] Patent Number: 4,542,943

[45] Date of Patent: Sep. 24, 1985

[54] EARTHWORKING TOOL FOR PROTECTING FROM ABNORMALLY HIGH CUTTING LOADS

[75] Inventor: Robert H. Montgomery, Jr., Bedford, Pa.

[73] Assignee: Kennametal Inc., Latrobe, Pa.

[21] Appl. No.: 719,029

[22] Filed: Apr. 3, 1985

Related U.S. Application Data

[63] Continuation of Ser. No. 366,488, Apr. 8, 1982, abandoned.

[51] Int. Cl.[4] ..... E21C 35/18

[52] U.S. Cl. ..... 299/93; 299/91; 407/8; 407/120

[58] Field of Search ..... 299/12, 91, 92, 93; 175/379; 285/4; 403/2, 381, DIG. 3; 407/8, 120

[56] References Cited

U.S. PATENT DOCUMENTS

| | | | |
|---|---|---|---|
| 2,381,973 | 8/1945 | Ego | 172/271 |
| 3,010,744 | 11/1961 | Hollis | 172/271 X |
| 3,498,677 | 3/1970 | Morrow | 299/86 |
| 3,753,625 | 8/1973 | Fabrizio et al. | 81/471 |
| 3,820,849 | 6/1974 | Lundström | 299/93 |
| 3,846,030 | 11/1974 | Katt | 285/4 |
| 4,261,620 | 4/1981 | Troxler | 299/91 |
| 4,275,929 | 6/1981 | Krekeler | 299/91 |
| 4,343,516 | 8/1982 | Aden | 299/86 |
| 4,360,981 | 11/1982 | Bierwith et al. | 37/141 |

FOREIGN PATENT DOCUMENTS

| | | |
|---|---|---|
| 32428 | 7/1981 | European Pat. Off. . |
| 3113147 | 1/1982 | Fed. Rep. of Germany . |

*Primary Examiner*—Stephen J. Novosad
*Assistant Examiner*—Michael Goodwin
*Attorney, Agent, or Firm*—Lawrence R. Burns

[57] ABSTRACT

There is disclosed a base and block assembly for use with an earthworking bit. The assembly comprises a base and a block engaged in the base. The block has a shank portion and a toolholder portion extending from a first end of the shank and adapted for receiving the earthworking bit. The assembly also comprises means for causing the block to preferentially fail when exposed to abnormally high cutting loads. Also disclosed is a method for protecting the base of a base and block assembly when in use with an earthworking bit. The method comprises preferentially weakening the block so as to cause the block to fail when exposed to abnormally high cutting loads and engaging the block with the base.

16 Claims, 8 Drawing Figures

EARTHWORKING TOOL FOR PROTECTING FROM ABNORMALLY HIGH CUTTING LOADS

This is a continuation of application Ser. No. 366,488, filed Apr. 8, 1982 now abandoned.

BACKGROUND OF THE INVENTION

This invention is related to the field of earthworking tools such as those used on machines for cutting rock or coal or machines for road building and road maintenance. For purposes of illustration, this invention will be shown and described with respect to a road planer, a particular type of road building and road maintenance equipment.

The tools with which this invention is most concerned are those tools comprised of a base, a block (sometimes called a lug), and a bit for contacting the working medium. The bit may be any one of several types which are well known in the prior art.

A normal consequence of utilizing tools is an abrasive working medium such as the earth is that the tools wear out and must then be replaced. The period of time during replacement is greater when the bits are tipped with a hard wear resistant material such as tungsten carbide.

The tools are attached to a rotor which rotates causing the bits to dig into the earth. Often, the base and block are welded to the rotor while the bit is removably attached to the block. In normal operation, only the bit has to be replaced. However, it is recognized that the block itself may also wear out or even break. In this circumstance, the whole machine must be shut down so that a welder may be located for the purpose of removing the old block and then installing a new one. There is considerable expense involved in allowing such an expensive machine to lay idle.

Thus, it is desirable to also make the block replaceable as is, for example, shown in U.S. Pat. Nos. 2,905,456; 3,820,849; and 4,180,292.

This only partially solves the problem since, if an underground obstacle is encountered, such as buried railroad tracks, manhole rings, expansion plates or deck plates on bridges, an abnormally high cutting load will be put on the bit, and the base itself may be ripped from the rotor. If this occurs, the machine will then have to be shut down and a welder will have to be located as before.

A way to remedy the situation is to make the base and block sufficiently massive so that, together, they can withstand the resultant cutting forces. This is shown, for example, in U.S. Pat. No. 3,749,449. A consequence of this design is that the rotor becomes very heavy due to the "beefed-up" base and block so that the force available for cutting action through the bit is somewhat reduced. Of course, such a design would also be more expensive.

An alternative to the problems of the prior art has been provided by the invention of this application.

Thus, it is an object of this invention to provide a base and block assembly that is both lightweight and durable.

It is another object that the base and block assembly be cost effective.

It is a further object that the block of a base and block assembly be replaceable and yet be rigidly held by the base when in operation It is a still further object of this invention that the base of a base and block assembly be protected from abnormally high cutting loads.

BRIEF SUMMARY OF THE INVENTION

According to the present invention, disclosed is an assembly for use with an earthworking bit. There is a base and a block engaged in the base. The block has a shank portion and a toolholder portion. The toolholder portion extends from a first end of the shank and is adapted for receiving an earthworking bit. There is also means for causing the block to preferentially fail when exposed to abnormally high cutting loads.

The base has a T-shaped recess formed by the intersection of a vertical slot and a horizontal slot. The block has a T-shaped portion extending from a second end of the shank portion. When fully assembled, the T-shaped portion slidably engages the T-shaped recess.

The failure means is disposed on the shank portion and, preferably, it is on the shank portion between the toolholder portion and the T-shaped portion. Preferably, also, the failure means comprises a segment of said shank portion in which the cross section is reduced from the remainder of the shank portion. Most preferably, the reduced cross section area segment comprises a groove situated along at least one peripheral surface of the shank portion.

The base also has a top portion of two intersecting surfaces. Each of the top portion surfaces is inclined to the horizontal. The block also has a bottom portion of two intersecting surfaces extending outwardly from the first end of the shank portion. Each of the bottom portion surfaces is inclined to the horizontal. The top portion surfaces of the base directly oppose the bottom portion surfaces of the block when the block engages the base. Preferably, the angle that each of the top portion surfaces of the base and the angle that each of the bottom portion surfaces of the block makes with the horizontal is about 10 degrees.

Even more preferably, the horizontal slot and the top portion surfaces of the base diverge from one another toward the rear of the base. The T-shaped portion and the bottom portion surfaces of the block diverge in a similar manner from one another toward the rear of the block. The base and the block become wedgingly engaged due to this divergence as the block moves rearwardly in the base.

Also, according to the invention, the base and block assembly preferably comprise means for retaining the block in the base in immovable engagement. Preferably, the retaining means comprise fastening means, a threaded recess in the rear of the shank portion and a perforation in the rear of the T-shaped recess. The perforation and threaded recess are in alignment when the block engages the base. The fastening means passes through the perforation and engages the threaded recess.

According to the invention, a block is disclosed for use with an earthworking bit. There is a shank portion and a toolholder portion extending from a first end of the shank and adapted for receiving the earthworking bit. There are also means for causing the block to preferentially fail when exposed to abnormally high cutting loads.

Preferably, the block also has a T-shaped portion extending from a second end of the shank portion.

Preferably, also, the failure means is disposed on the shank portion. More preferably, it is on the shank portion between the toolholder portion and the T-shaped portion. The failure means comprises a segment of the shank portion in which the cross section area is reduced from the remainder of the shank portion. It is most preferable that the reduced cross section area segment comprises a groove situated along at least one peripheral surface of the shank portion.

The block also has a bottom portion of two intersecting surfaces extending outwardly from the first end of the shank portion. Each of the bottom portion surfaces is inclined to the horizontal. Preferably, the angle that each of the bottom portion surfaces makes with the horizontal is about 10 degrees. Preferably, the T-shaped portion and bottom portion surfaces diverge from one another toward the rear of the block.

According to the invention, there is also disclosed a method to protect the base of a base and block assembly when used with an earthworking bit. The method comprises preferentially weakening the block so as to cause the block to fail when exposed to abnormally high cutting loads and engaging the block with the base. Preferably, the step of preferentially weakening is by reducing the cross section area of a portion of the block. Most preferably, the step of reducing the cross section area is by forming a groove along at least one peripheral surface of the block.

BRIEF DESCRIPTION OF THE DRAWINGS

The exact nature of the present invention will become more clearly apparent upon reference to the following detailed specification taken in connection with the accompanying drawings in which.

DETAILED DESCRIPTION OF THE INVENTION

Figure 1:
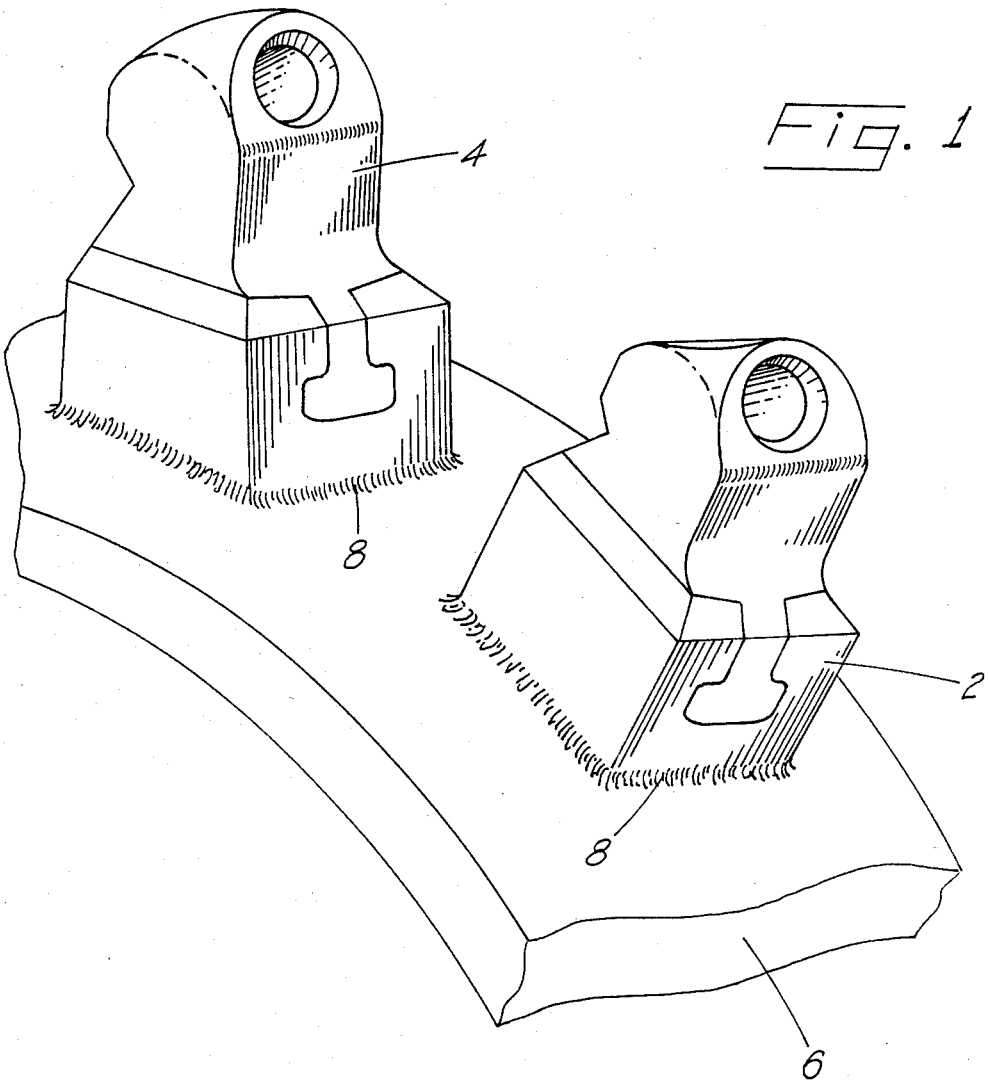
FIG. 1 is a perspective view of a bit and block assembly on a rotor.

Referring to the drawings in more detail, FIG. 1 shows the base 2 and the block 4 as it would normally appear on the rotor 6. As can be seen, the base is welded 8 to the rotor.

Figure 2:
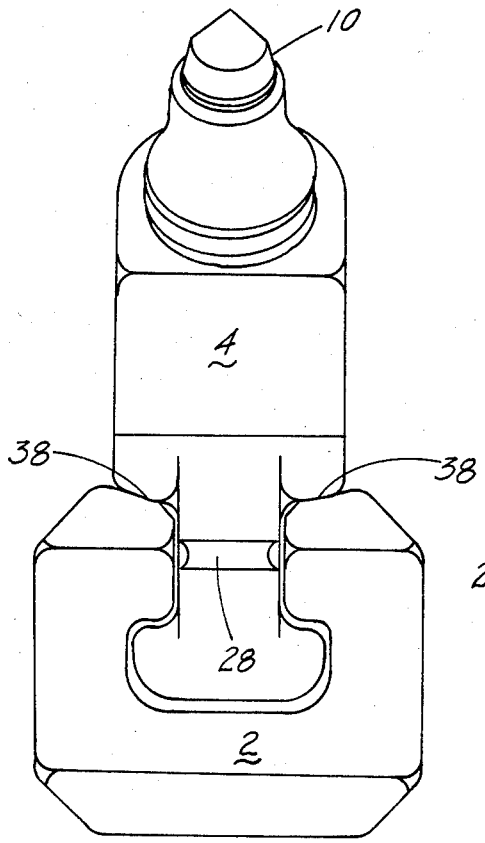
FIG. 2 is a front view of a base and block assembly with an earthworking bit.
Figure 3:
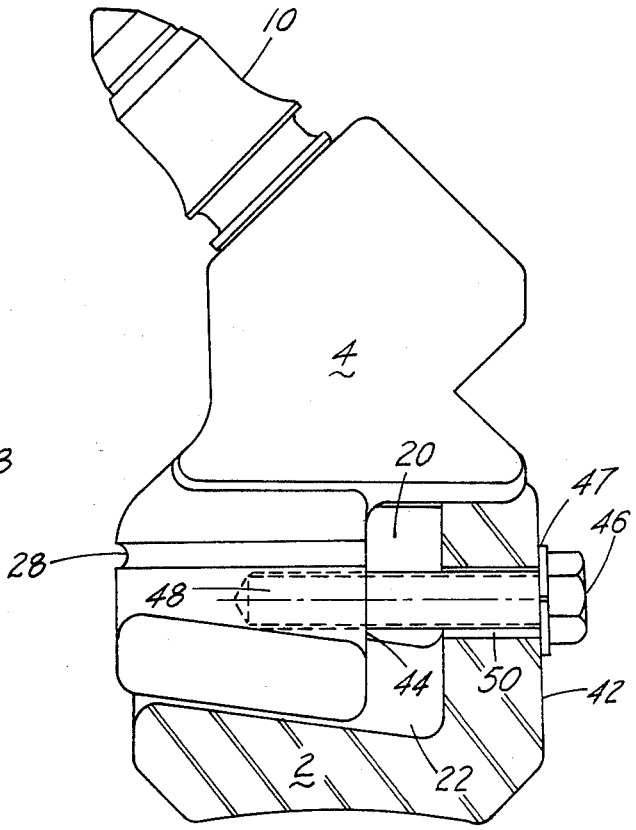
FIG. 3 is a side view of a base and block assembly with an earthworking bit.
Figure 4:
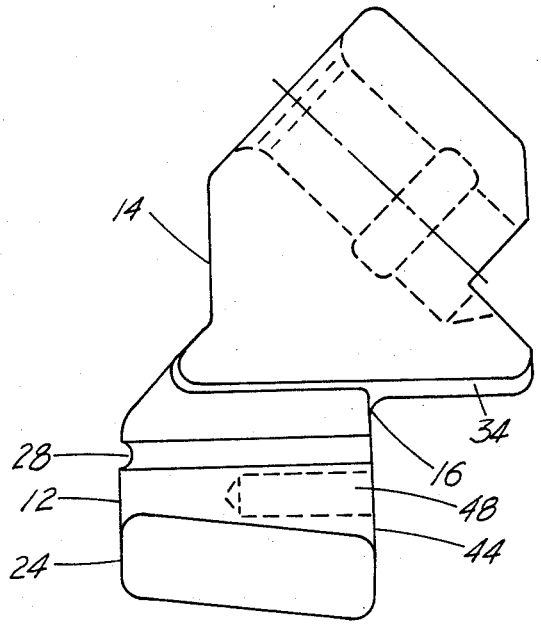
FIG. 4 is a side view of the block.
Figure 5:
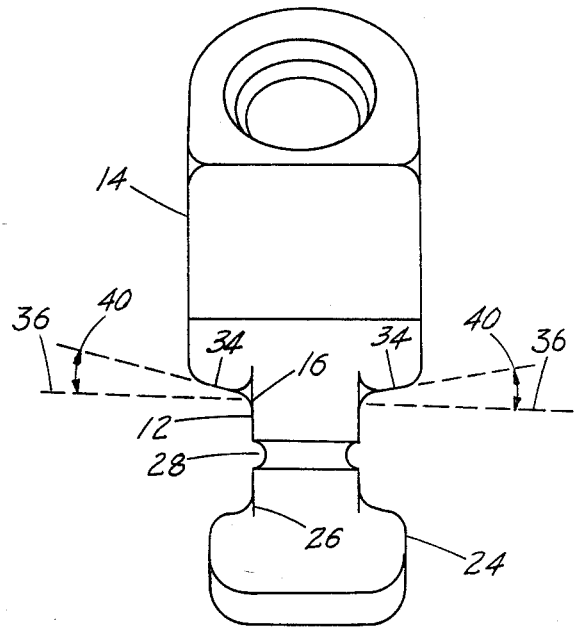
FIG. 5 is a front view of the block.
Figure 6:
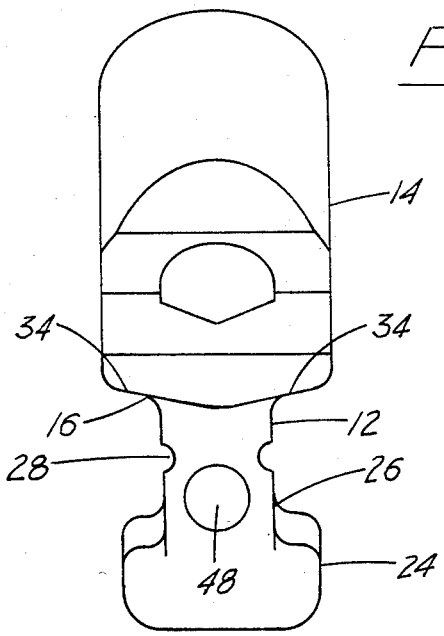
FIG. 6 is a rear view of the block.
Figure 7:
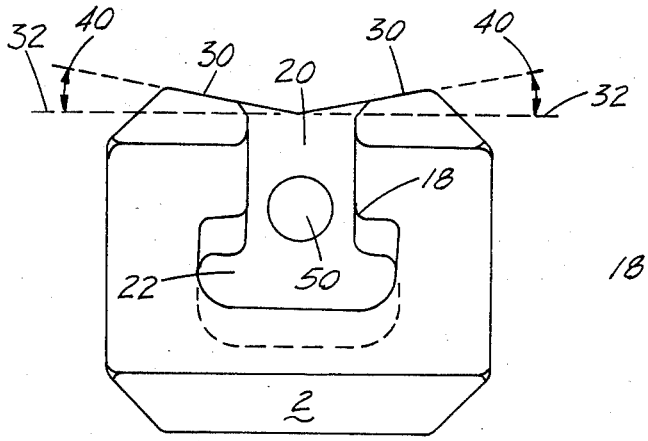
FIG. 7 is a front view of the base.
Figure 8:
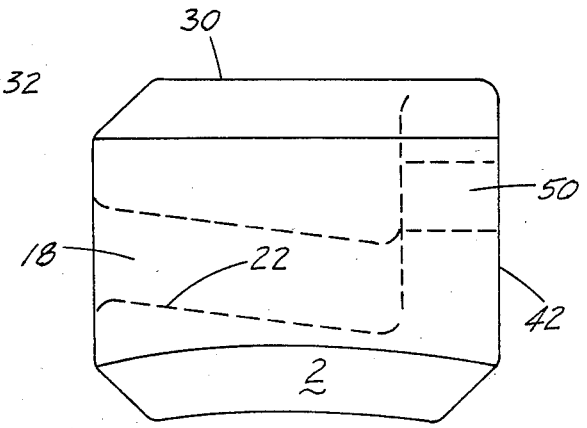
FIG. 8 is a side view of the base.

FIGS. 2 and 3 show the base 2 and the block 4 with an earthworking bit 10. The bit shown is a rotatable bit with a captive keeper, but may be any one of several types which are well known in the prior art. The section of the base in FIG. 3 is illustrative of the engagement of the base, block and fastening means.

Referring now additionally to FIGS. 4 through 8, there is disclosed according to the invention an assembly for use with an earthworking bit. There is a base 2 and a block 4 engaging the base. The block has a shank portion 12 and a toolholder portion 14 extending from a first end 16 of the shank and adapted for receiving an earthworking bit 10. There are also means for causing the block to preferentially fail when exposed to abnormally high cutting loads.

The base has a T-shaped recess 18 formed by the intersection of a vertical slot 20 and a horizontal slot 22. The block has a T-shaped portion 24 extending from a second end 26 of the shank portion. The T-shaped portion slidably engages the T-shaped recess.

Preferably, the failure means is disposed on the shank portion. More preferably, the failure means may also be disposed on the shank portion between the toolholder portion and the T-shaped portion. The failure means comprises a segment of the shank portion in which the cross section is reduced from the remainder of the shank portion. Most preferably, the reduced cross section area segment comprises a groove 28 situated along at least one peripheral surface of the shank portion.

It is necessary so as to fulfill the objectives of the invention that the groove be located along at least one peripheral surface; however, it is contemplated within the scope of the invention that the groove may also be located on two, three or all of the peripheral surfaces of the shank portion.

Similar designs, such as any thinning of the cross section of the shank, are also contemplated within the scope of this invention.

The base may also have a top portion of two intersecting surfaces 30. Each of the top portion surfaces is inclined to the horizontal 32. The block also has a bottom portion of two intersecting surfaces 34 extending outwardly from the first end 16 of the shank portion. Each of the bottom portion surfaces is inclined to the horizontal 36. The top portion surfaces 30 of the base directly oppose the bottom portion surfaces 34 of the block when the block engages the base.

This can best be seen in FIG. 2 where the top portion surfaces oppose the bottom portion surfaces at 38. The purpose of inclining the bottom portion surfaces and the top portion surfaces is to counteract side loading of the earthworking bit.

It is preferable that the angle 40 that each of the top portion surfaces of the base and the angle 40 that each of the bottom portion surfaces of the block makes with the horizontal is about 10 degrees.

Preferably, the horizontal slot 22 and the top portion surfaces 30 of the base diverge from one another toward the rear 42 of the base. The T-shaped portions 24 and the bottom portion surfaces 34 of the block diverge in a similar manner from one another toward the rear 44 of the block. The base and block become wedgingly engaged due to this divergence as the block moves rearwardly in the base.

Also, according to the invention, there are means for retaining the base and block in immovable engagement. It is desirable to retain the base and block in immovable engagement so as to avoid unnecessary wear between the base and the block.

Preferably, the retaining means comprise a fastening means, a threaded recess 48 in the rear 44 of the shank portion and a perforation 50 in the rear 42 of the T-shaped recess 18. The perforation 50 and the threaded recess 48 are in alignment when the block engages the base. The fastening means passes through the perforation and engages the threaded recess.

The fastening means is preferably a bolt 46 and lock washer 47 as shown in FIG. 3. However, similar fastening means such as a bolt and spring are also contemplated within the scope of this invention.

According to the invention, disclosed is a block 4 for use with an earthworking bit 10. There is a shank portion 12 and a toolholder portion 14 extending from a first end 16 of the shank and adapted for receiving an earthworking bit 10. There are also means for causing the block to preferentially fail when exposed to abnormally high cutting loads. The block also has a T-shaped portion 24 extending from a second end 26 of the shank portion.

Preferably, the failure means is disposed on the shank portion, or even more preferably, is disposed on the shank portion between the toolholder portion and the T-shaped portion. The failure means comprises a segment of the shank portion in which the cross section area is reduced from the remainder of the shank portion. Most preferably, the reduced cross section area segment comprises a groove 28 situated along at least one peripheral surface of the shank portion.

While a groove is particularly shown and described, any similar feature that causes the cross section of the shank portion to be reduced in area is contemplated within the scope of the invention.

The block has a bottom portion of two intersecting surfaces 34 extending outwardly from the first end 16 of the shank portion. Each of the bottom portion surfaces is inclined to the horizontal 36. The purpose of inclining the surface is to counteract the side loading of the earthworking bit. Preferably, the angle 40 that each of the bottom portion surfaces makes with the horizontal is about 10 degrees.

Preferably, also, the block has a T-shaped portion 24 and bottom portion surfaces 34 diverging from one another toward the rear 44 of the block.

According to the invention, disclosed is a method to protect the base of a base and block assembly when used with an earthworking bit. The method comprises preferentially weakening the block so as to cause the block to fail when exposed to abnormally high cutting loads and engaging the block with the base.

It is anticipated that this method will cause the block to fail first when exposed to abnormally high cutting loads, or at least to deform so as to preclude further service, thereby preventing the base from being ripped off the rotor.

Preferably, the step of preferentially weakening comprises reducing the cross section area of a portion of said block. Most preferably, the step of reducing the cross section area comprises forming a groove 28 along at least one peripheral surface of the block. While a groove is particularly shown and described as the most preferred method of preferentially weakening, similar designs which cause the cross section of the block to be reduced in area are contemplated within the scope of the invention.

Modifications may be made within the scope of the appended claims.

What is claimed is:

1. An assembly for use with an earthworking bit, comprising: a base having a T-shaped recess formed by the intersection of a vertical slot and a horizontal slot; a block engaging said base, said block having a shank portion and a toolholder portion extending from a first end of said shank and adapted for receiving an earthworking bit; said block having a T-shaped portion extending from a second end of said shank portion with said T-shaped portion slidably engaging said groove; and said shank having means for causing said block to preferentially fail when exposed to abnormally high cutter loads and located between said toolholder portion and said T-shaped portion.

2. The assembly of claim 1 wherein said failure means comprises a segment of said shank portion in which the cross section area is reduced from the remainder of the shank portion.

3. The assembly of claim 2 wherein said reduced cross area segment comprises a groove situated along at least one peripheral surface of said shank portion.

4. The assembly of claim 1 wherein the base further comprises a top portion of two intersecting surfaces, each of said top portion surfaces inclined to the horizontal; and the block further comprises a bottom portion of two intersecting surfaces extending outwardly from the first end of said shank portion, each of said bottom portion surfaces inclined to the horizontal, said top portion surfaces of said base directly opposing said bottom portion surfaces of said block when said block engages said base.

5. The assembly of claim 4 wherein the angle that each of said top portion surfaces of base and each of said bottom portion surfaces of said block makes with the horizontal is about ten degrees.

6. The assembly of claim 4 wherein said horizontal slot and top portion surfaces of said base diverge from one another toward the rear of said base and said T-shaped portion and bottom portion surfaces of said block diverge in a similar manner from one another toward the rear of said block, said base and block becoming wedgingly engaged due to said divergence as said block moves rearwardly in said base.

7. The assembly of claim 1 further comprising means for retaining the base and block in immovable engagement.

8. The assembly of claim 7 wherein said retaining means comprises: fastening means; a threaded recess in the rear of said shank portion; and a perforation in the rear of said T-shaped recess, said perforation and threaded recess being in alignment when said block engages said base, said fastening means passing through said perforation and engaging said threaded recess.

9. The assembly of claim 1 wherein said means for preferential failure comprises a recess in the rear of said shank portion.

10. A block for use with an earthworking bit, comprising: a shank portion; a toolholder portion extending from a first end of said shank and adapted for receiving an earthworking bit; said block having a T-shaped portion extending from the second end of said shank portion, said T-shaped portion adapted for slidable engagement with a groove in a base member; and said shank having means for causing said block to preferentially fail when exposed to abnormally high cutting loads located between said toolholder portion and said T-shaped portion.

11. The block of claim 10 wherein said failure means comprises a segment of said shank portion in which the cross section area is reduced from the remainder of the shank portion.

12. The block of claim 11 wherein said reduced cross section area segment comprises a groove situated along at least one peripheral surface of said shank portion.

13. The block of claim 12 further comprising a bottom portion of two intersecting surfaces extending outwardly from the first end of said shank portion, each of said bottom portion surfaces inclined to the horizontal.

14. The block of claim 13 wherein the angle that each of said bottom portion surfaces makes with the horizontal is about ten degrees.

15. The block of claim 13 wherein said T-shaped portion and bottom portion surfaces diverge from one another toward the rear of said block.

16. The block of claim 10 wherein said failure means comprises a recess in the rear of said shank portion.

* * * * *